US011846488B2

(12) United States Patent
Zinsner et al.

(10) Patent No.: US 11,846,488 B2
(45) Date of Patent: Dec. 19, 2023

(54) FREE-FLOATING RIFLE RAIL AND BARREL LOCKING SYSTEM(S)/ASSEMBLIES

(71) Applicant: Brendon Zinsner, Sarasota, FL (US)

(72) Inventors: Brendon Zinsner, Sarasota, FL (US); Lisa Fitzgerald, Leesburg, FL (US)

(73) Assignee: Brendon Zinsner, Sarasota, FL (US)

( * ) Notice: Subject to any disclaimer, the term of this patent is extended or adjusted under 35 U.S.C. 154(b) by 0 days.

(21) Appl. No.: 18/195,734

(22) Filed: May 10, 2023

(65) Prior Publication Data

US 2023/0280127 A1 Sep. 7, 2023

Related U.S. Application Data

(63) Continuation of application No. 17/724,623, filed on Apr. 20, 2022, now Pat. No. 11,656,058, which is a continuation of application No. 17/143,614, filed on Jan. 7, 2021, now Pat. No. 11,326,853.

(60) Provisional application No. 62/957,852, filed on Jan. 7, 2020.

(51) Int. Cl.
*F41C 23/16* (2006.01)
*F41A 21/48* (2006.01)

(52) U.S. Cl.
CPC ..... *F41C 23/16* (2013.01); *F41A 21/48* (2013.01)

(58) Field of Classification Search
CPC ..... F41A 11/04; F41A 21/48; F41A 21/484; F41A 21/487; F41C 23/16
USPC ..... 42/71.01
See application file for complete search history.

(56) References Cited

U.S. PATENT DOCUMENTS

| | | | | |
|---|---|---|---|---|
| 7,313,883 | B2 * | 1/2008 | Leitner-Wise | F41A 21/484 42/75.02 |
| 8,667,882 | B1 * | 3/2014 | Larson | F41A 35/06 89/142 |
| 8,863,426 | B1 * | 10/2014 | Zinsner | F41C 23/16 42/75.01 |
| 8,931,196 | B1 | 1/2015 | Larue | |
| 9,476,663 | B2 * | 10/2016 | Selvetti | F41A 11/02 |
| 10,359,248 | B2 | 7/2019 | Zinsner et al. | |
| 10,401,122 | B2 * | 9/2019 | Williams | F41G 11/003 |
| 10,641,568 | B2 | 5/2020 | Zinsner et al. | |
| 10,935,343 | B2 * | 3/2021 | Chin | F41A 11/00 |
| 10,989,494 | B1 * | 4/2021 | Sylvester | F41A 21/482 |
| 11,326,853 | B2 | 5/2022 | Zinsner et al. | |
| 11,656,058 | B2 * | 5/2023 | Zinsner | F41A 21/482 42/71.01 |
| 2012/0036756 | A1 * | 2/2012 | Brown | F41A 5/26 89/193 |
| 2015/0308779 | A1 * | 10/2015 | McGinty | F41A 21/484 42/75.02 |
| 2022/0404119 | A1 | 12/2022 | Zinsner et al. | |

* cited by examiner

*Primary Examiner* — Joshua E Freeman
*Assistant Examiner* — Benjamin S Gomberg
(74) *Attorney, Agent, or Firm* — Shumaker, Loop & Kendrick, LLP

(57) ABSTRACT

A free-floating rifle rail and barrel locking system that provides a barrel assembly and rail assembly, which is detachable from the main body of a rifle without tools. This is advantageous for quick field breakdown and/or rifle modification. The user has the option to disassemble the rifle for easy transport, to change barrel length, to change barrel caliber or change rail configurations. The rails are free-floating, meaning the rails do not come in contact with the barrel and thus do not impact the precision of the rifle.

17 Claims, 13 Drawing Sheets

FREE-FLOATING RIFLE RAIL AND BARREL LOCKING SYSTEM(S)/ASSEMBLIES

TECHNICAL FIELD

The present invention relates generally to the field of rifles, and more particularly, to free-floating, quick release rifle rail and barrel locking systems/assemblies that are easily attached to and detached from the main body of a rifle (e.g., assault rifle main bodies) without tools.

BACKGROUND

Shooting enthusiasts have many commercially-available options to configure their AR-15 rifle(s), AR-10 rifle(s), and/or variants thereof for personal taste and/or shooting styles. These include, but are not limited to, optical scopes, laser sights, lights, tripods, barrel lengths and calibers. These options and accessories are available with standard attachment interfaces, including KeyMod and M-Lok. Commercially-available rail systems typically have one or both interfaces that are securely attached to the rifle but are not easily removed without specialized tools and expertise along with a lengthy time period for doing so. Although the shooting enthusiast may desire the quick and interchangeable use of one of more of the above-mentioned accessories on their rifle, the shooting enthusiast may not have the time, tools, and/or expertise to accomplish this skilled task, which is often very problematic to the enthusiast lacking one or more of the above-mentioned attributes.

SUMMARY

Thus, a need exists to provide the shooting enthusiast with an alternative that overcomes the above-mentioned problems. Thus, specifically disclosed is a free-floating, quick release rifle rail and barrel locking system(s) (also referred to as "quick release assembly" and/or "rail assembly" and/or "barrel assembly") that are detachable from the main body of a rifle (also referred to as "rifle assembly" or "assault rifle assembly") without tools. Attachment and detachment of these assemblies to the rifle main body are quite easy and can often be accomplished in less than, for example, 10 minutes or even 5 minutes without any additional tools. The disclosed systems/assemblies use a hand-activated lever/latch system to easily remove both rail and barrel assemblies from the main body of a rifle. This eliminates the necessity for specialized tools and complex disassembly of the AR-15 rifle system, AR-10 rifle system, and/or variants thereof to change or add KeyMod/M-Lok accessories or complete rail systems. Thus, the disclosed systems/assemblies provide simplicity and allow the user to quickly change barrel(s) as desired.

In certain aspects disclosed is a quick release assembly configured for attachment to an rifle assembly (assault rifle assembly), the quick release assembly comprising: (a) a rail assembly including: (i) a sleeve configured to directly attach to the rifle assembly (assault rifle assembly); (ii) an elongate rail mount having a first end and second end that are spaced apart from one another and a first and second securing levers positioned on opposite sides of an outer surface of the elongate rail mount, wherein: the first end of the elongate rail mount securely receives the sleeve of the rail assembly therein, and the spaced apart second end of the elongate rail mount and first and second securing levers are configured to securely mate within a rail of the rail assembly; and (iii) a rail having a first end and second end that are spaced apart from one another, wherein: the first end of the rail is configured to receive and securely mate with the second end of the elongate rail mount to axially align the sleeve, elongate rail mount, and rail along the longitudinal axis of the rail assembly, the first end of the rail further includes slots positioned on opposite sides of the rail that are configured to receive the securing levers of the elongate rail mount therein to securely engage and disengage the elongate rail mount to the rail, and the second end of the rail is configured to receive the barrel assembly therein; and (b) the barrel assembly including a barrel having a first end and a second end that are spaced apart from one another, wherein: a portion of the barrel assembly is configured to advance through the rail of the rail assembly and is securely received within the second end of the elongate rail mount such that the barrel assembly and rail assembly are axially aligned to form an internal channel in fluid communication with the rifle assembly (assault rifle assembly).

In certain aspects, the elongate rail mount and rail comprises apertures on each respective first end that are perpendicular to a longitudinal axis of the rail and barrel assemblies (when assembled).

In certain aspects, the apertures on each respective first end of the elongate rail mount and rail are configured to align with one another when the quick release assembly is assembled.

In certain aspects, the first end of the elongate rail mount and rail are configured to fasten to one another by advancing a fastener within the aligned apertures on each respective first end of the elongate rail mount and rail.

In certain aspects, the barrel assembly is secured within the elongate rail mount and rail by the fastener positioned within the aligned apertures of each respective first end of the elongate rail mount and rail.

In certain aspects, the fastener and apertures on each respective first end of the elongate rail mount and rail are configured for a threaded engagement or snap fit engagement. In certain aspects, the fastener is a screw having a threaded outer diameter that engages the threaded apertures (inner diameter of each aperture) positioned on the first end of the elongate rail mount and the first end of the rail.

In certain aspects, the slots positioned on the first end of the rail further comprise an internal compartment configured to securely receive an end of the first and second securing levers therein when the quick release assembly is assembled to securely mate each respective securing lever internally within and to the rail. In certain aspects, the slots have two opposing ends with one end being more proximate to the sleeve of the rail assembly (and the rifle assembly) and one end of the slot being more proximate to an end of the barrel (that is the end of the fully assembled rifle), and in this aspect, the internal compartments of the rail being on an end of the slots In certain aspects, the each lever is biased in a direction towards exterior of the rail to securely maintain position of the levers within the internal compartments of the rail when quick release assembly is assembled (as well as securely maintain engagement between the rail mount and rail).

In certain aspects, the first and second securing levers are recessed and in parallel planes with an outer surface of the rail when in an engaged state.

In certain aspects, the first and second securing levers is perpendicular relative to the longitudinal axis of the rail assembly when in a disengaged state.

In certain aspects, the rail assembly, barrel assembly, or a combination thereof are detachable from the rifle assembly (assault rifle assembly) without the use of any additional tools.

In certain aspects and also disclosed is a rail assembly for use in a quick release attachment to an rifle assembly (assault rifle assembly), the rail assembly comprising: (i) a sleeve configured to directly attach to the rifle assembly (assault rifle assembly); (ii) an elongate rail mount having a first end and second end that are spaced apart from one another and a first and second securing levers positioned on opposite sides of an outer surface of the elongate rail mount, wherein: the first end of the elongate rail mount securely receives the sleeve of the rail assembly therein, and the spaced apart second end of the elongate rail mount an first and second securing levers are configured to securely mate within a rail of the rail assembly; and (iii) a rail having a first end and second end that are spaced apart from one another, wherein: the first end of the rail is configured to receive and securely mate with the second end of the elongate rail mount to axially align the sleeve, elongate rail mount, and rail along the longitudinal axis of the rail assembly, the first end of the rail further includes slots positioned on opposite sides of the rail that are configured to receive the securing levers of the elongate rail mount therein to securely engage and disengage the elongate rail mount to the rail, and the second end of the rail is configured to receive the barrel assembly therein.

In certain aspects, the elongate rail mount and rail comprises apertures on each respective first end that are perpendicular to a longitudinal axis of the rail and barrel assemblies (when assembled).

In certain aspects, the apertures on each respective first end of the elongate rail mount and rail are configured to align with one another when the rail assembly is assembled.

In certain aspects, the first end of the elongate rail mount and rail are configured to fasten to one another by advancing a fastener within the aligned apertures on each respective first end of the elongate rail mount and rail. In certain aspects, the fastener is a screw having a threaded outer diameter that engages the threaded apertures (inner diameter of each aperture) positioned on the first end of the elongate rail mount and the first end of the rail.

In certain aspects, the rail assembly is configured to secure a barrel assembly within the elongate rail mount and rail by the fastener positioned within the aligned apertures of each respective first end of the elongate rail mount and rail.

In certain aspects, the fastener and apertures on each respective first end of the elongate rail mount and rail are configured for a threaded engagement or snap fit engagement.

In certain aspects, the slots positioned on the first end of the rail further comprise an internal compartment configured to securely receive an end of the first and second securing levers therein when the rail assembly is assembled to securely mate each respective securing lever of the elongate rail mount internally within and to the rail.

In certain aspects, each lever is biased in a direction towards exterior of the rail to securely maintain position of the levers within the internal compartments of the rail when the rail assembly is assembled.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

Figure 1:
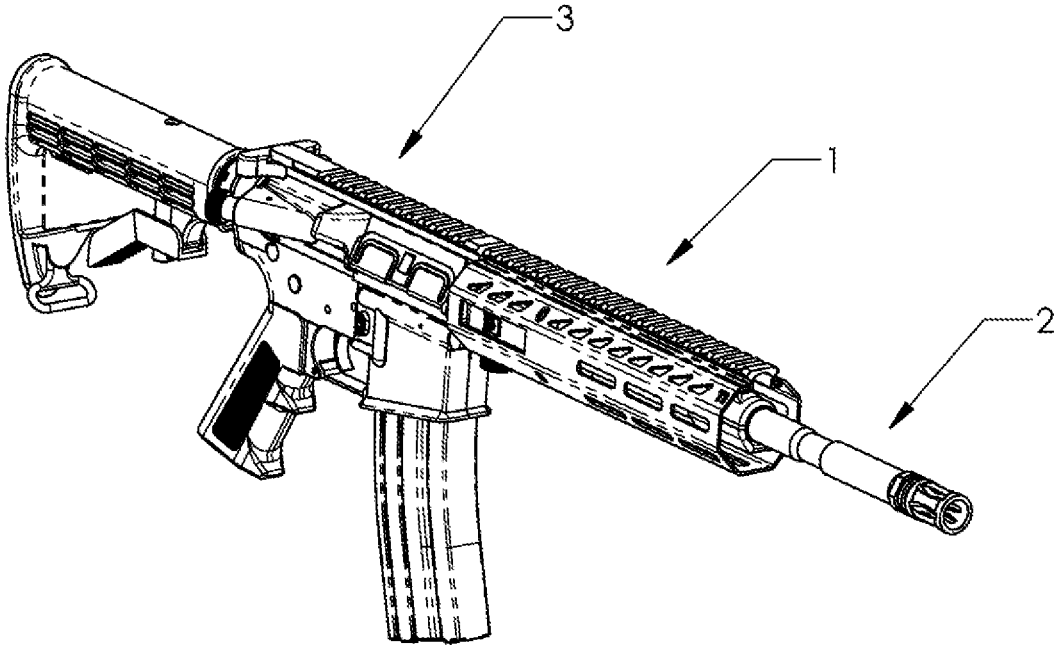
FIG. 1 is an Isometric view of the rail and barrel assemblies.
Figure 2:
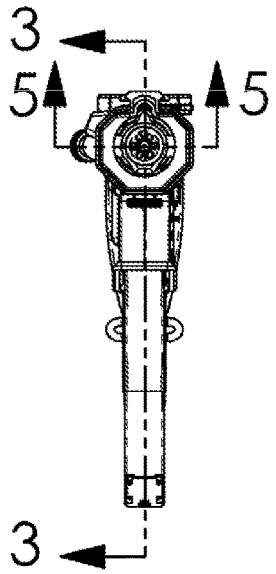
FIG. 2 is a Front view of the rail and barrel assemblies.
Figure 3:
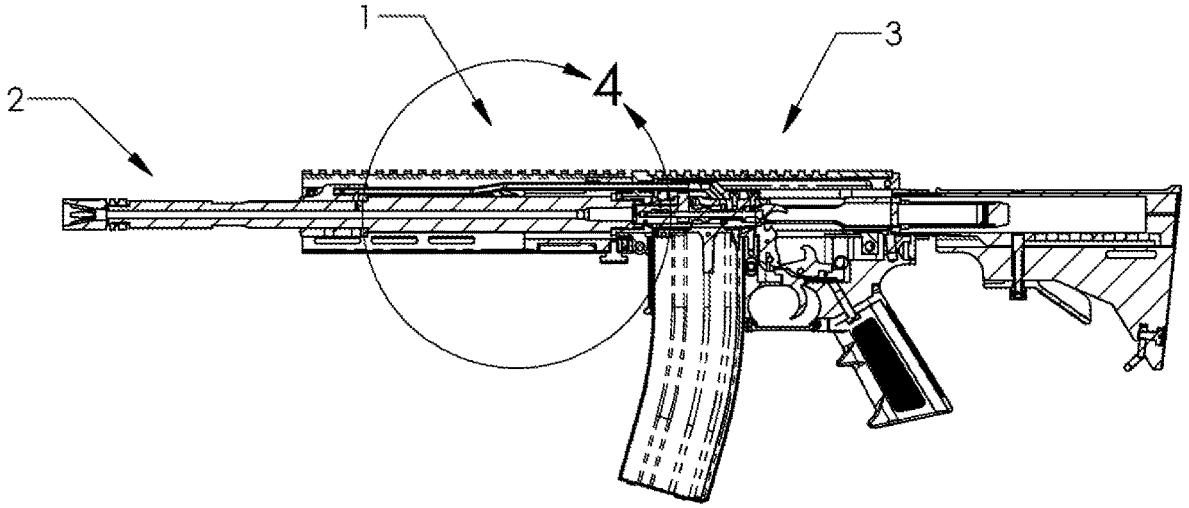
FIG. 3 is a Left Section View of FIG. 2.
Figure 4:
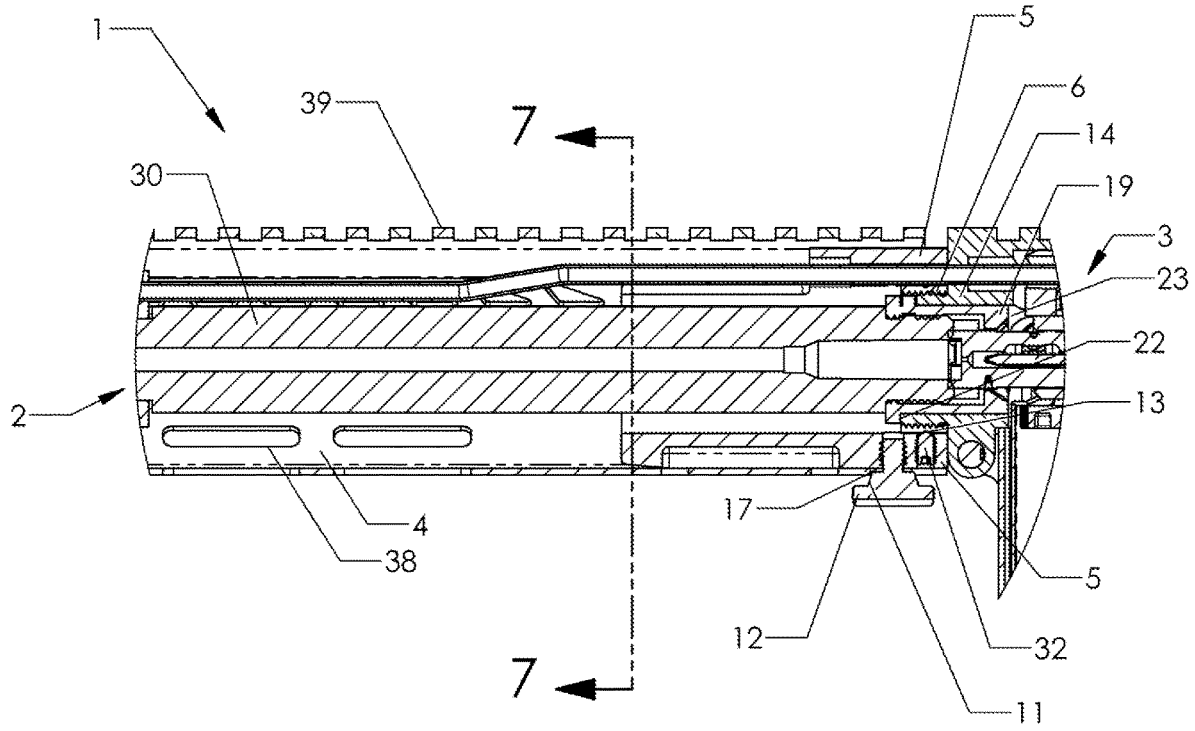
FIG. 4 is a magnified Detail View of FIG. 3.
Figure 5:
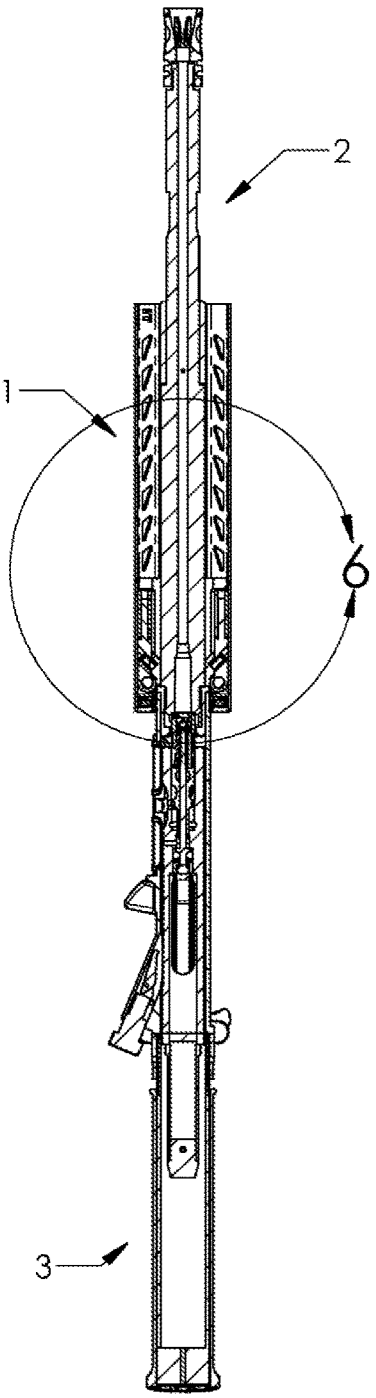
FIG. 5 is a Top Section View of FIG. 3 further depicting the rail and barrel assemblies.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

The present invention will now be described more fully hereinafter with reference to the accompanying drawings which exemplary embodiments of the invention are shown. However, the invention may be embodied in many different forms and should not be construed as limited to the representative embodiments set forth herein. The exemplary embodiments are provided so that this disclosure will be both thorough and complete and will fully convey the scope of the invention and enable one of ordinary skill in the art to make, use and practice the invention. Like reference numbers refer to like elements throughout the various drawings.

Referring to FIGS. 1, 2, 3, 8, 9, 12, 15, 16, 17, 18 and 19, the rail assembly 1 and barrel assembly 2 are an integral part of the AR-15/10 rifle assembly 3. Rail assembly 1 and barrel assembly 2 are detachable from the main AR-15/10 rifle assembly 3 by means of three attachment points as described herein.

Referring to FIGS. 2, 3, 4, 5, 6, 7, 8, 9, 10, 11, and 12, rail assembly 1 includes the rail 4 and accessory mount 39. The accessory mount 39 is designed to accept commercially available accessories for the AR-15/10 rifle. The accessory mount 39 is attached to rail 4 by means of a plurality of rail stud projections 35 nesting in a rail groove 34 on each side of accessory mount 39. Rail 4 includes a plurality of M-lock slots 38. In this embodiment, slots are designed to accept M-lock type commercially available accessories. In other embodiments, the slot configuration can be changed to accept KeyMod or other types of commercially available accessories.

Figure 13:
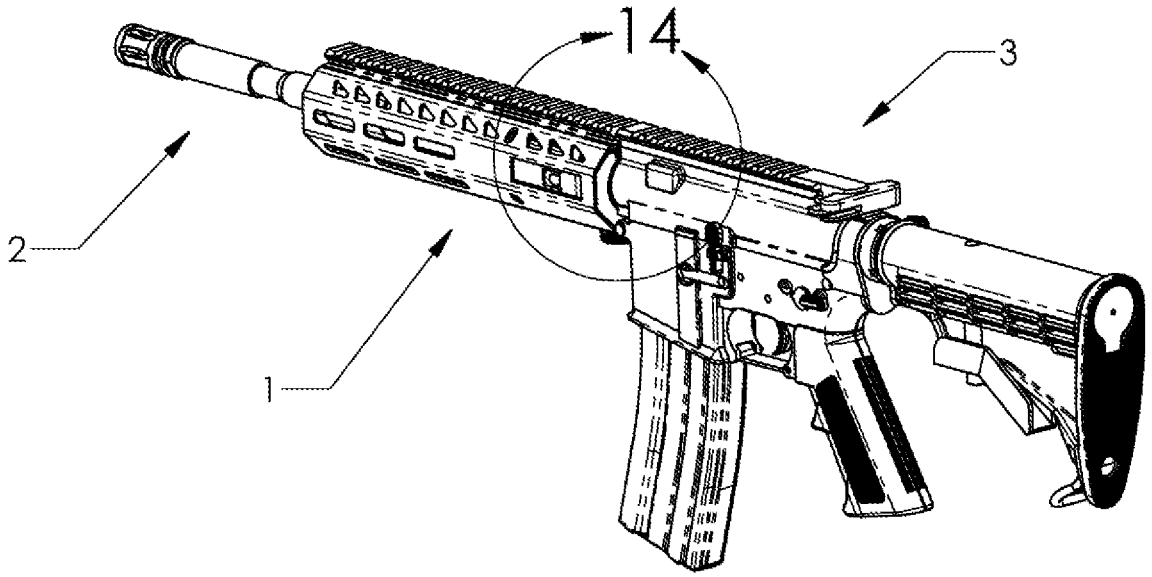
FIG. 13 is another Isometric view of the rail and barrel assemblies.
Figure 14:
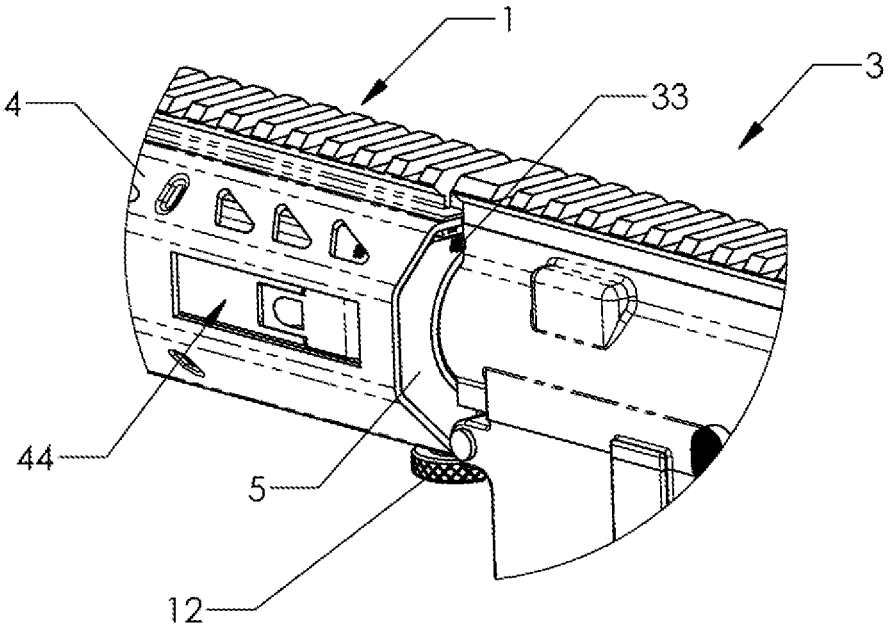
FIG. 14 is a magnified Detail view of FIG. 15.
Figure 15:
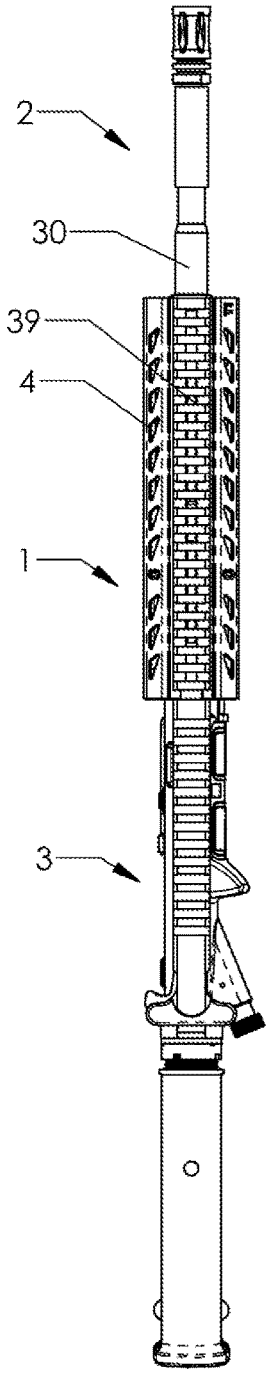
FIG. 15 is a Top view of the rail and barrel assemblies.
Figure 16:
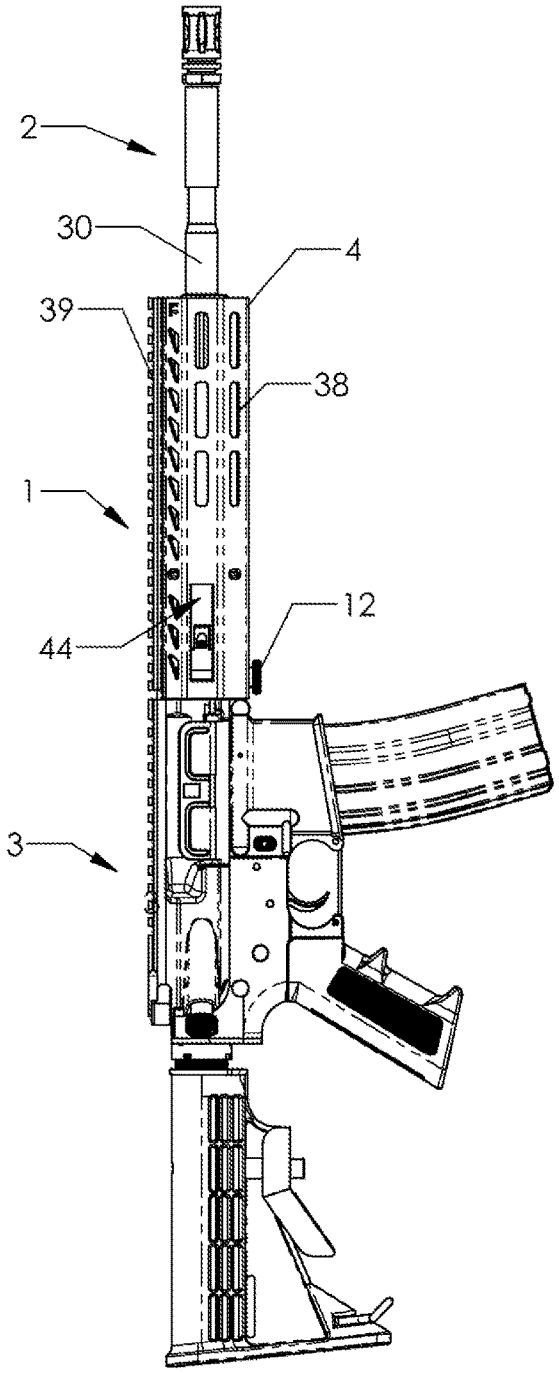
FIG. 16 is a Side view of the rail and barrel assemblies.
Figure 17:
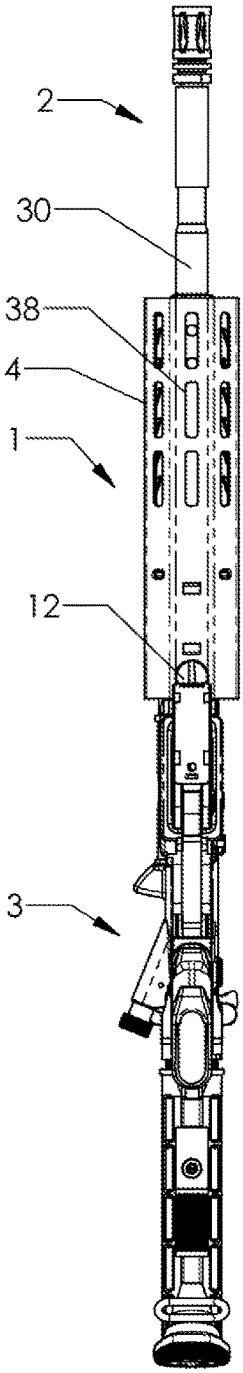
FIG. 17 is a Bottom view of the rail and barrel assemblies.
Figure 18:
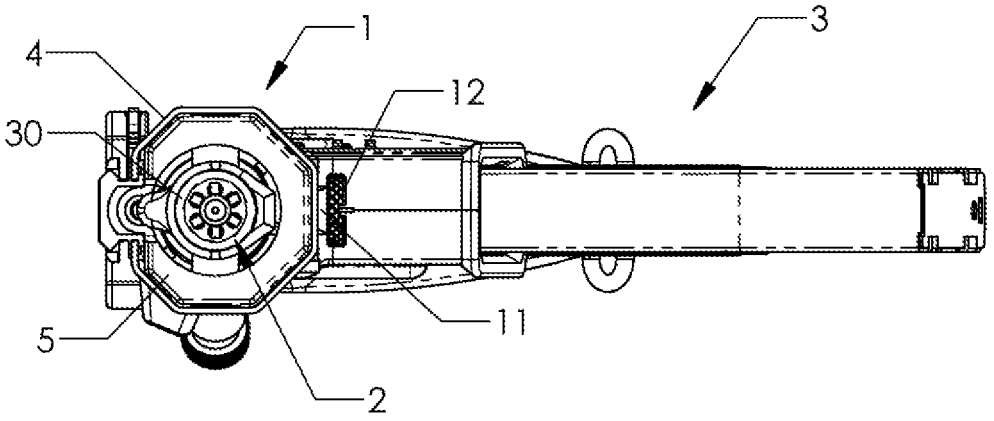
FIG. 18 is a Front view of the rail and barrel assemblies.
Figure 19:
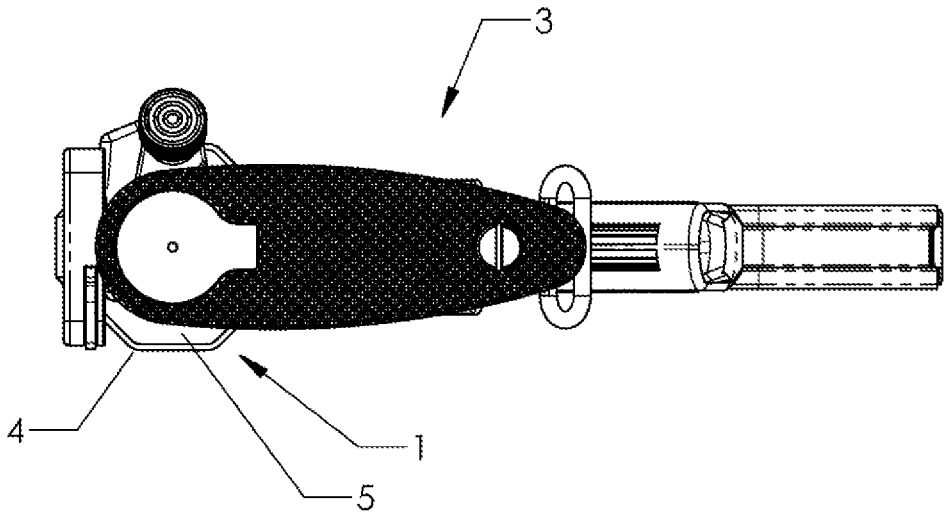
FIG. 19 is a Rear view of the rail and barrel assemblies.
Figure 20:
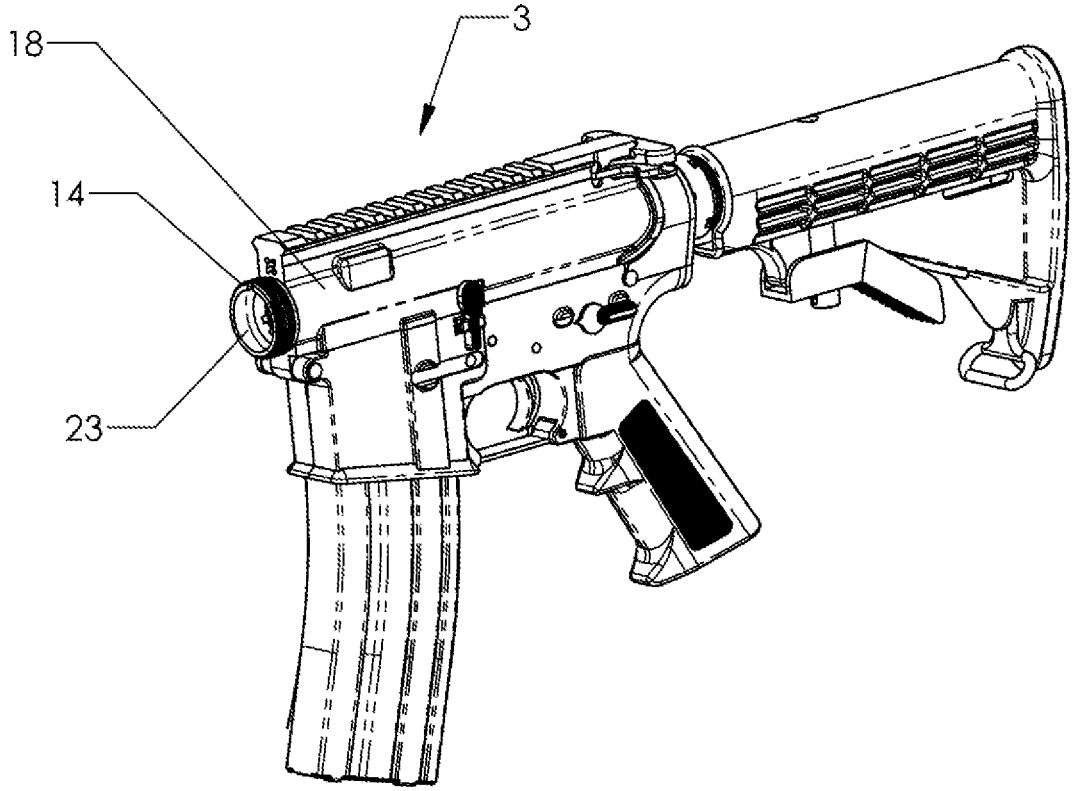
FIG. 20 is an Isometric view of the rifle assembly.

Referring to FIGS. 4, 5, 6, 8 9, 10, 11, 12, and 20, rail mount 5 is attached to the AR-15/10 rifle assembly 3 by means of interface nut 6 connected onto receiver threaded barrel mount 14 on upper receiver 18. Rail mount 5 is slid onto and attached to interface nut 6 by a polarity of rail mount set screws 32 tightened into the interface nut notch 13. Referring to FIGS. 13 and 14, receiver set screws 33 on rail mount 5, aligns rail mount 5 by contacting the surface on each side of the upper receiver 21. This becomes the attachment point for rail assembly 1 and barrel assembly 2.

Referring to FIGS. 2, 5, 6, 7, 11, 12, 15, 16, 17, and 18, rail mount 5 is permanently secured to the AR-15/10 rifle assembly 3. Rail 4 is slid onto and tightly positioned onto rail mount 5 by the interior surfaces of rail 4 contacting the rear mating surfaces 40 and front mating surfaces 37 on rail mount 5. The rail 4 is also positioned by a plurality of raised mounting projections 36 contacting the front mating surface 37 on rail mount 5. The interface of the mounting projections 36 on rail 4 and the front mating surfaces 37 on rail mount 5 cause a slight distortion of the manufactured shape of rail mount 4, thereby ensuring a tight fit to rail mount 5.

Referring to FIGS. 2, 5, 6, 7, 11, 12, 15, 16, 17, 18, 19 and 20, the barrel assembly 2 is comprised of the barrel 30, barrel extension 19 and other features required for operation of the gun. To fully install the barrel into the AR-15/10 rifle assembly 3, the barrel assembly 2 is slid through rail assembly 1 and rail mount 5 until barrel extension 19 is fully engaged in the barrel extension receiver 23, an integral feature of the upper receiver 18. The barrel assembly 2 is secured to the AR-15/10 rifle assembly 3 by two lever assemblies 44. Each lever assembly is comprised of a pressure lock lever 7, barrel lock lever 27 and barrel lock adjustment screw 31. A pressure lock lever slide 28, an integral part of pressure lock lever 7, slides and is captured into barrel lever aperture 21, an integral part of barrel lock lever 27 and is locked together by barrel lock adjustment screw 31. Pressure lock lever 7 is affixed and freely rotatable by lever pin 8, secured in lever pin aperture 20, a feature of rail mount 5. Rail mount 5 translates pressure to hold the barrel assembly 2 tight and secure to the upper receiver 18, through lever pin 8, pressure lock lever 7, adjustment screw 31, and barrel lock lever 27.

Figure 6:
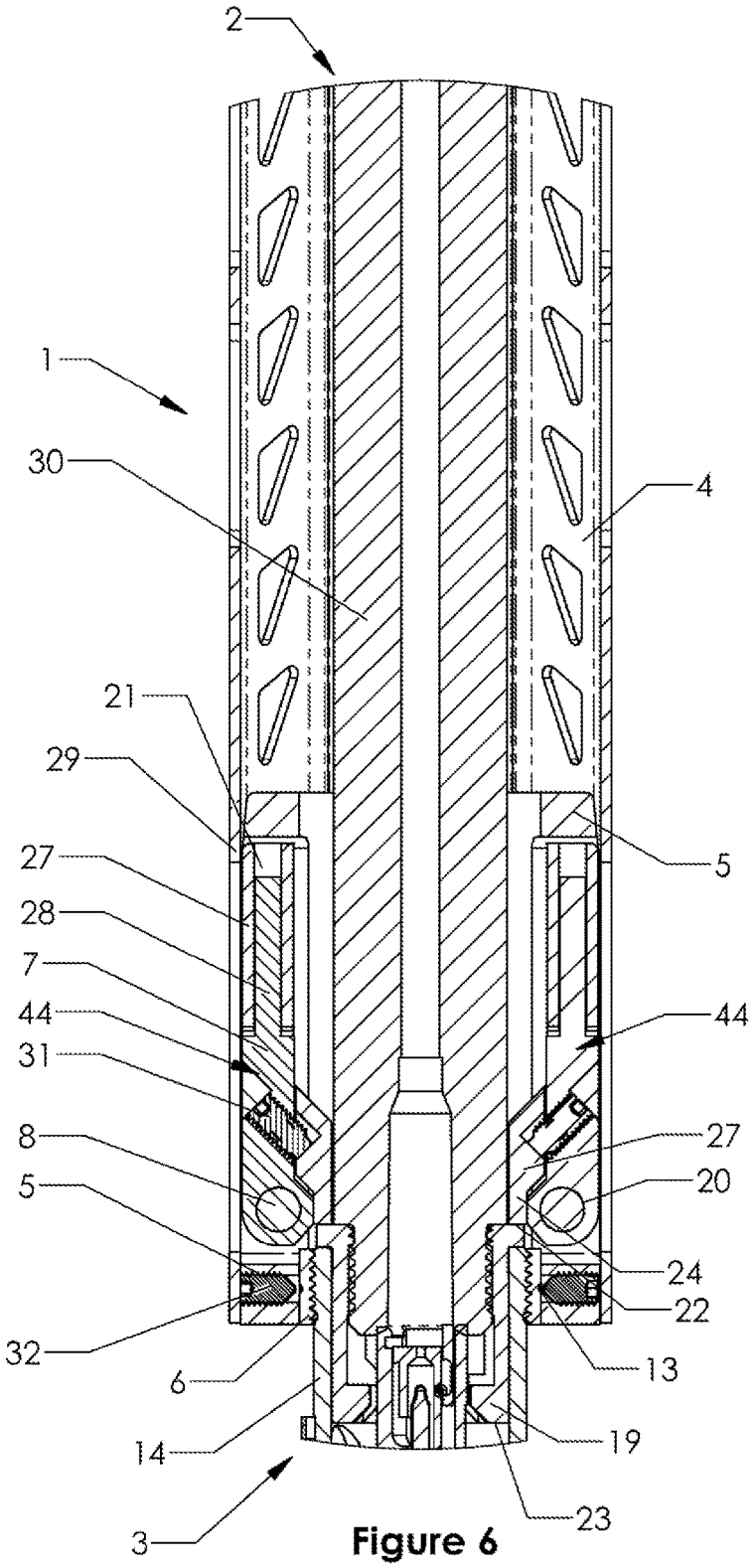
FIG. 6 is a magnified Detail View of FIG. 5.
Figure 7:
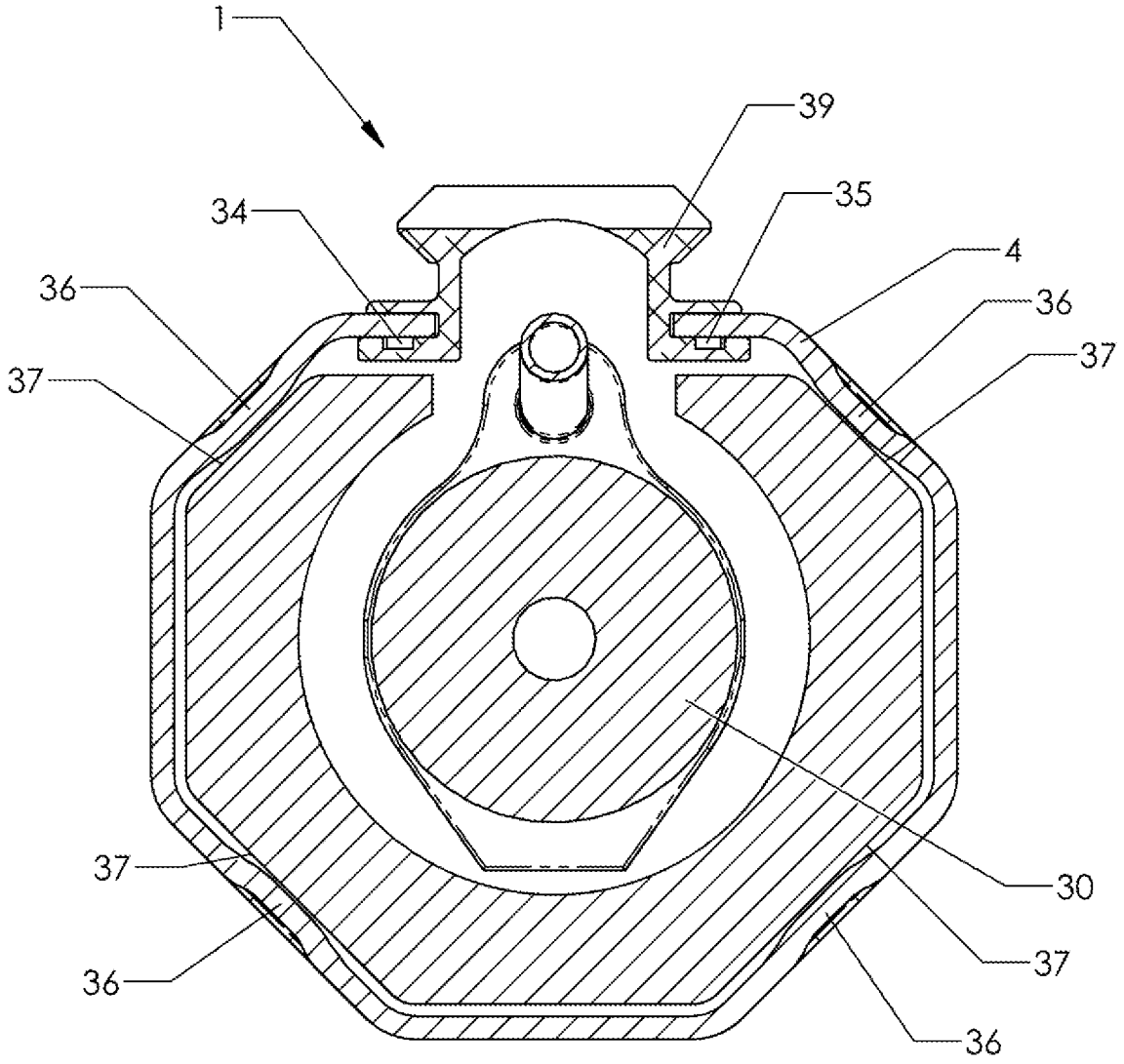
FIG. 7 is a Section View of FIG. 4.
Figure 8:
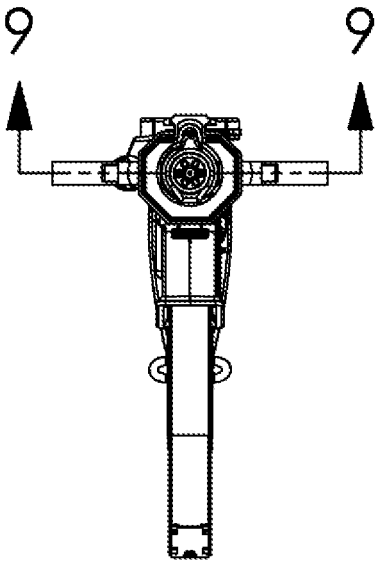
FIG. 8 is a Front view of the rail and barrel assemblies.
Figure 9:
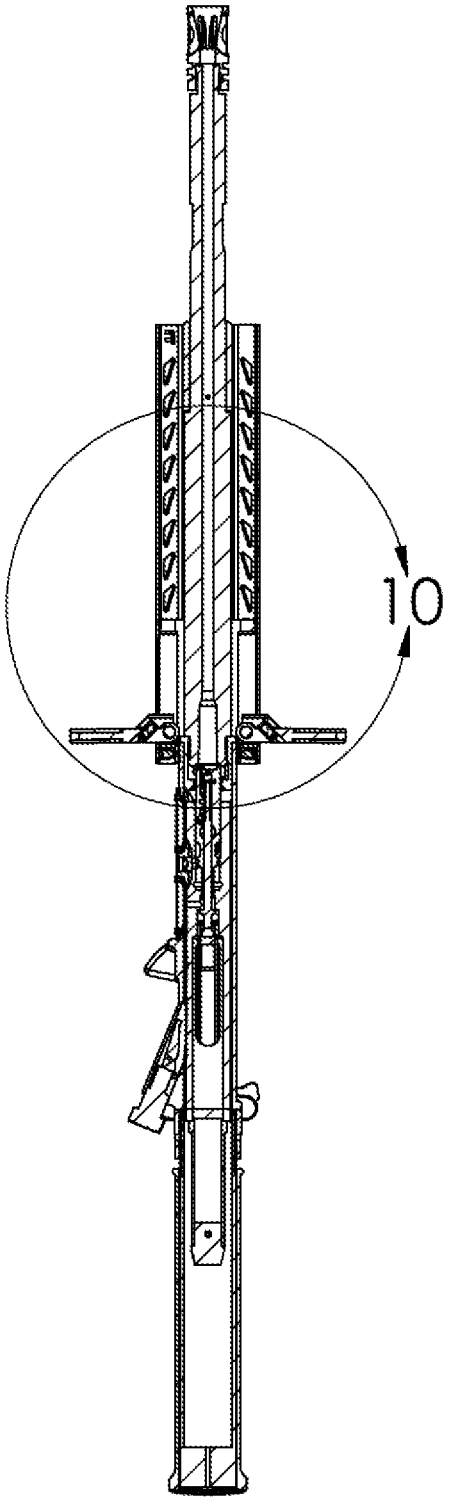
FIG. 9 is a Section view of FIG. 8.

Referring to FIG. 6, as the lever assemblies 44 are rotated to the fully closed position through barrel lever rail aperture 42 in rail 4, the retainer pawl 24, an integral part of barrel lock lever 27, contacts the barrel extension face 22, an integral part of barrel extension 19, to secure the barrel assembly 2 to the AR-15/10 rifle assembly 3. To insure a tight fit of the barrel assembly 2, within the tolerance range of the multitude of components, the barrel lock adjustment screw 31 allows adjustment of the distance between the retainer pawl 24, relative to the lever pin aperture 20 on rail mount 5 and the barrel extension face 22, on barrel extension 19.

The lever assemblies 44 are held secure in the closed and locked position by the rail overlap edge 29 on rail 4 as rail assembly 1 is slid back to the normal fully installed position held by rail retainer screw 12. Rail retainer screw 12 aligns and fixes rail 4 in the exact fully installed position by the rail retaining screw taper 11, an integral part of rail retainer screw 12, self-aligning and centering in the rail screw mounting aperture 17 on rail 4. This secures rail assembly 1 to rail mount 5 and therefore to AR-15/10 rifle assembly 3.

Loosening rail retainer screw 12 allows rail 4 to move, in direction 41, to a position where rail overlap edge 29 is clear of any interference with lever assemblies 44, thereby allowing lever assemblies 44 to swing to an outward open position.

Figure 10:
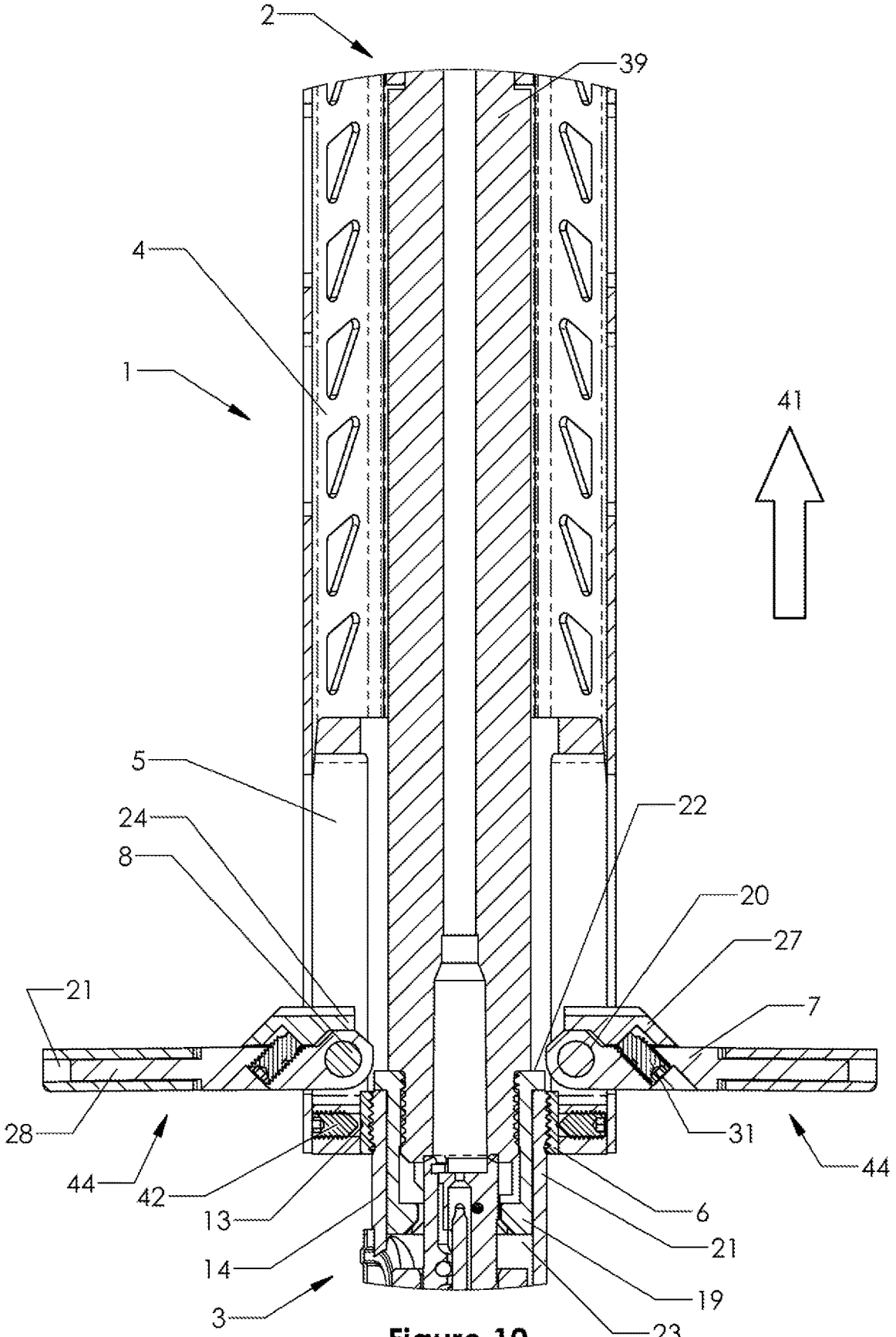
FIG. 10 is a magnified Detail view of FIG. 9.
Figure 11:
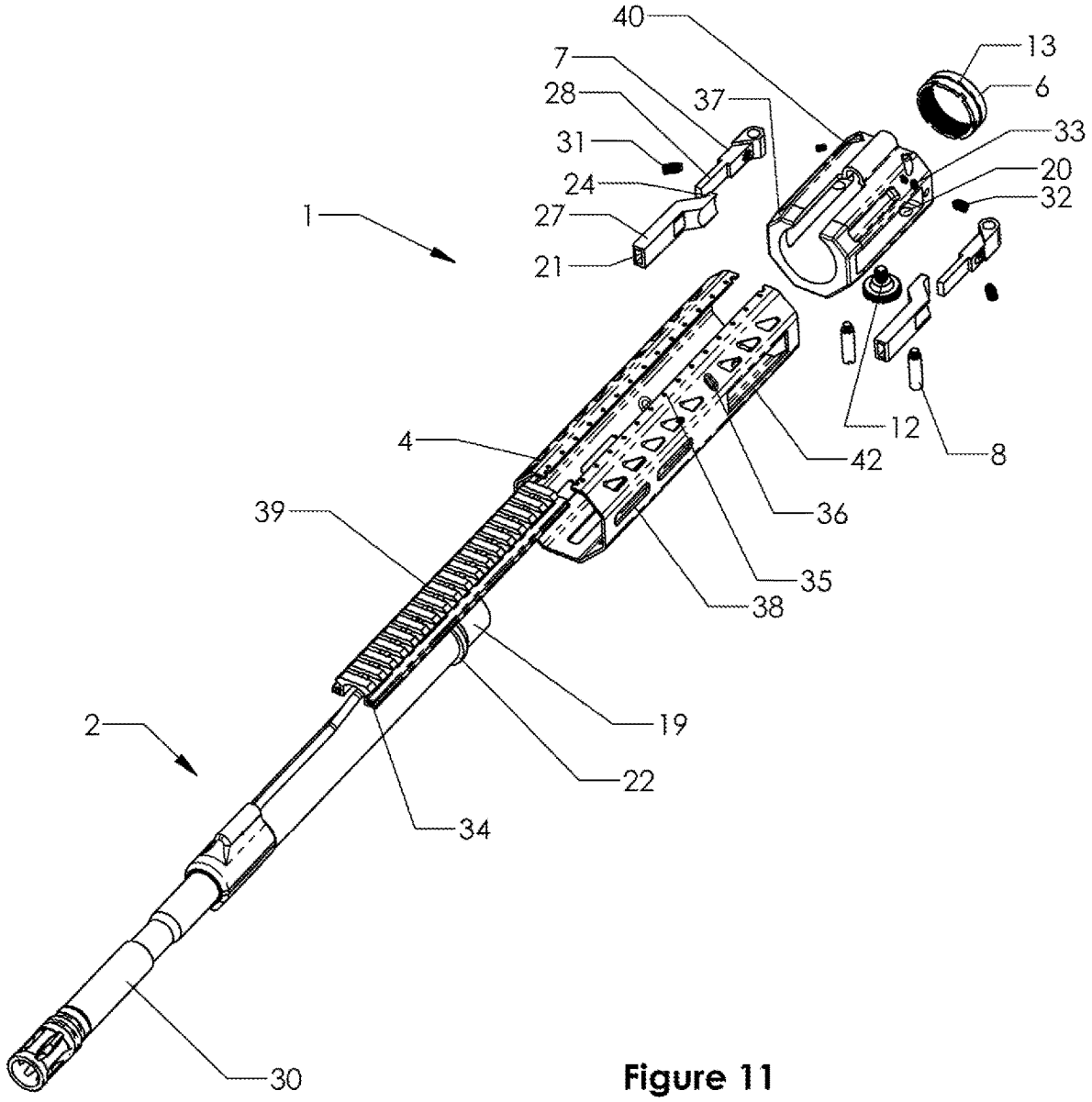
FIG. 11 is an Exploded isometric view of the rail and barrel assemblies.
Figure 12:
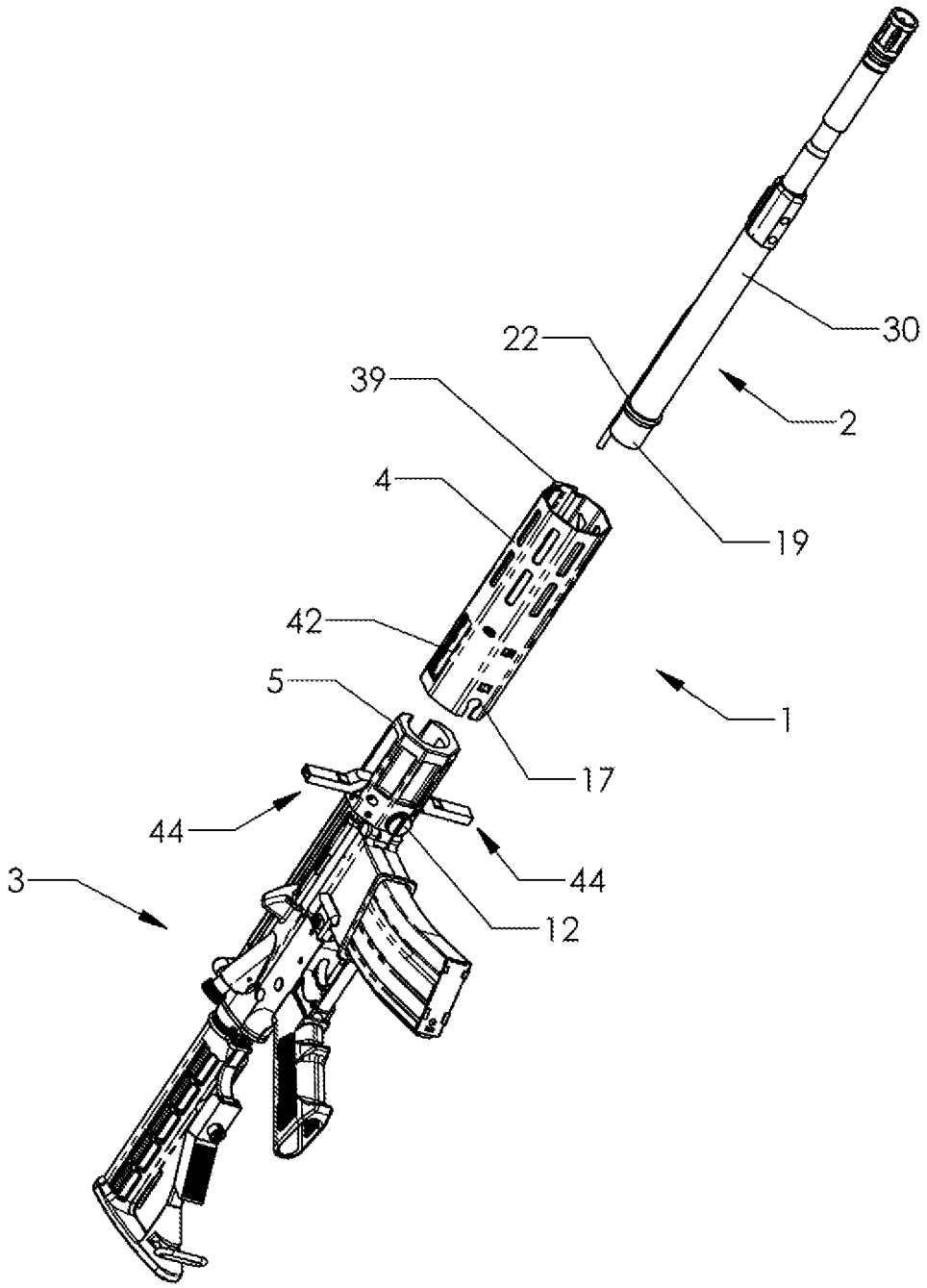
FIG. 12 is another Exploded isometric view of the rail and barrel assemblies.

Referring to FIG. 10, as the lever assemblies 44 are rotated to the fully open position, the retainer pawl 24 allows the barrel assembly 2 to be removed from the AR-15/10 rifle assembly 3 in direction 41. After removal, the lever assemblies 44 can be rotated back to a closed position through barrel lever rail aperture 42 in rail 4. Rail assembly 1 can then be removed in direction 41.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

1 rail system
2 barrel assembly
3 AR-15/10 rifle assembly
4 Rail
5 rail mount
6 interface nut
7 pressure lock lever
8 lever pin
9 Not Used
10 Not Used
11 rail retaining screw taper
12 rail retainer screw
13 interface nut notch
14 receiver threaded barrel mount
15 Not Used
16 Not Used
17 rail screw mounting aperture
18 upper receiver
19 barrel extension
20 lever pin aperture
21 barrel lock lever aperture
22 barrel extension face
23 barrel extension receiver
24 Not Used
25 Not Used
26 Not Used
27 barrel lock lever
28 pressure lock lever slide
29 rail overlap edge
30 Barrel
31 barrel lock adjustment screw
32 rail mount set screw
33 receiver set screw
34 accessory mount groove
35 rail stud projection

36 mounting projection
37 front mating surface
38 M-lock slots
39 accessory mount
40 rear mating surface
41 Direction
42 barrel lever rail aperture
43 Not Used
44 lever assembly

What is claimed is:

1. A release assembly configured for attachment to a rifle assembly, the release assembly comprising:

(a) a rail assembly including:

(i) a sleeve that attaches to the rifle assembly;

(ii) an elongate rail mount having a first end and second end that are spaced apart from one another and a securing lever positioned on an outer surface of the elongate rail mount, wherein:

the first end of the elongate rail mount receives the sleeve of the rail assembly therein, and the spaced apart second end of the elongate rail mount and the securing lever are configured to mate within a rail of the rail assembly; and (iii) the rail having a first end and second end that are spaced apart from one another, wherein:

the first end of the rail is configured to receive and mate with the second end of the elongate rail mount to align the sleeve, elongate rail mount, and rail along a longitudinal axis of the rail assembly, the first end of the rail further includes slots positioned on the rail that are configured to receive the securing lever of the elongate rail mount therein to engage and disengage the elongate rail mount to the rail, and the second end of the rail is configured to receive a barrel assembly therein; and (b) the barrel assembly including a barrel having a first end and a second end that are spaced apart from one another, wherein:

a portion of the barrel assembly is configured to move through the rail of the rail assembly and be received within the second end of the elongate rail mount such that the barrel assembly and rail assembly are aligned to form an internal channel.

2. The release assembly of claim 1, further comprising an aperture in the first end of each of the elongate rail mount and the rail that is perpendicular to the longitudinal axis of the rail assembly.

3. The release assembly of claim 2, wherein the aperture in the first end of the elongate rail mount and the aperture in the first end of the rail are configured to align with one another when the rail and the elongate rail mount mate to one another.

4. The release assembly of claim 3, wherein the first end of the elongate rail mount and rail are configured to fasten to one another by advancing a fastener within the aligned apertures.

5. The release assembly of claim 4, wherein the barrel assembly is secured within the elongate rail mount and rail by the fastener positioned within the aligned apertures.

6. The release assembly of claim 5, wherein the fastener and apertures are configured for a threaded engagement or snap fit engagement.

7. The release assembly of claim 1, wherein the slots positioned on the first end of the rail further comprise an internal compartment configured to receive an end of the securing lever therein securely mate the securing lever internally within the rail when the first end of the rail receives and securely mates with the second end of the elongate rail mount.

8. The release assembly of claim 1, wherein the securing lever is recessed and in a parallel plane relative to an outer surface of the rail when engaged with the rail.

9. The release assembly of claim 1, wherein the securing lever is perpendicular relative to the longitudinal axis of the rail assembly when in a disengaged state.

10. The release assembly of claim 1, wherein the rail assembly, barrel assembly, or a combination thereof are detachable from the rifle assembly without the use of any additional tools.

11. A rail assembly for use in a release attachment to a rifle assembly, the rail assembly comprising:

(I) a sleeve configured to attach to the rifle assembly;

(ii) an elongate rail mount having a first end and second end that are spaced apart from one another and a securing lever positioned on an outer surface of the elongate rail mount, wherein:

the first end of the elongate rail mount receives the sleeve therein, and the spaced apart second end of the elongate rail mount and the securing lever are configured to mate within a rail; and (iii) the rail having a first end and second end that are spaced apart from one another, wherein:

the first end of the rail is configured to receive and securely mate with the second end of the elongate rail mount to align the sleeve, elongate rail mount, and rail along a longitudinal axis of the rail assembly, the first end of the rail further includes slots positioned on the rail that are configured to receive the securing lever of the elongate rail mount therein to engage and disengage the elongate rail mount to the rail, and the second end of the rail is configured to receive a barrel assembly therein.

12. The rail assembly of claim 11, further comprising an aperture in the first end of each of the elongate rail mount and the rail that is perpendicular to the longitudinal axis of the rail assembly.

13. The rail assembly of claim 12, wherein the aperture in the first end of the elongate rail mount and the aperture in the first end of the rail are configured to align with one another when the rail and the elongate rail mount mate to one another.

14. The rail assembly of claim 13, wherein the first end of the elongate rail mount and rail are configured to fasten to one another by advancing a fastener within the aligned apertures.

15. The rail assembly of claim 14, wherein the fastener and apertures are configured for a threaded engagement or snap fit engagement.

16. The rail assembly of claim 15, wherein the slots positioned on the first end of the rail further comprise an internal compartment configured to securely receive an end of the securing lever therein to securely mate the securing lever internally within and to the rail when the first end of the rail receives and securely mates with the second end of the elongate rail mount.

17. The rail assembly of claim 16, wherein the securing lever is biased in a direction towards an exterior of the rail to securely maintain position of the lever within the internal compartment of each of the slots when the first end of the rail receives and securely mates with the second end of the elongate rail mount.

* * * * *